US010656548B2

(12) United States Patent
Yoshiyama et al.

(10) Patent No.: US 10,656,548 B2
(45) Date of Patent: May 19, 2020

(54) IMAGE FORMING APPARATUS WITH A CHARGING POWER SUPPLY THAT OUTPUTS AN AC BIAS AND A DC BIAS

(71) Applicant: KONICA MINOLTA, INC., Chiyoda-ku, Tokyo (JP)

(72) Inventors: Tsugihito Yoshiyama, Toyohashi (JP); Masayasu Haga, Toyokawa (JP); Sayaka Morita, Gamagori (JP); Kunitomo Sasaki, Aichi (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 16/549,496

(22) Filed: Aug. 23, 2019

(65) Prior Publication Data

US 2020/0103780 A1 Apr. 2, 2020

(30) Foreign Application Priority Data

Oct. 1, 2018 (JP) ..... 2018-186457

(51) Int. Cl.
*G03G 15/02* (2006.01)
*G03G 15/16* (2006.01)

(52) U.S. Cl.
CPC ..... *G03G 15/0266* (2013.01); *G03G 15/1665* (2013.01)

(58) Field of Classification Search
CPC ..... G03G 15/0266; G03G 15/0283
USPC ..... 399/50
See application file for complete search history.

(56) References Cited

U.S. PATENT DOCUMENTS 6,463,240 B2 * 10/2002 Onuki et al. ..... G03G 15/0266 399/128

FOREIGN PATENT DOCUMENTS

| | | | |
|---|---|---|---|
| JP | H04037776 | A | 2/1992 |
| JP | H11160965 | A | 6/1999 |
| JP | H11272023 | A | 10/1999 |
| JP | 2003217035 | A | 7/2003 |
| JP | 2007094354 | A | 4/2007 |
| JP | 2018045114 | A | 3/2018 |

* cited by examiner

*Primary Examiner* — William J Royer
(74) *Attorney, Agent, or Firm* — Buchanan Ingersoll & Rooney PC

(57) ABSTRACT

An image forming apparatus includes: a photoreceptor; a charging member that charges the photoreceptor; a charging power supply that outputs an AC bias as a charging bias to be applied to the charging member during image formation, and outputs a DC bias as the charging bias during a non-image forming operation, the AC bias being obtained by superimposing an alternating current voltage and a direct current voltage, the image formation forming a latent image, the DC bias being a direct current voltage, the non-image forming operation rotating and driving the photoreceptor; a processor that performs predetermined processing on the photoreceptor; and a controller that controls the charging power supply and the processor such that a value of a potential difference of the photoreceptor before and after being charged by the DC bias is a value equal to or less than a setting value during the non-image forming operation.

8 Claims, 8 Drawing Sheets

92

| | | FILM THICKNESS D OF PHOTORECEPTOR | | |
|---|---|---|---|---|
| | | 28μm OR MORE | 28 TO 25μm | LESS THAN 25μm |
| HUMIDITY R [%] | R > 80 | 300 [V] | 400 [V] | 600 [V] |
| | 80 ≥ R > 70 | 400 [V] | 500 [V] | 800 [V] |
| | 70 ≥ R > 60 | 500 [V] | 700 [V] | 1000 [V] |
| | 60 ≥ R > 40 | 600 [V] | 800 [V] | 1000 [V] |
| | 40 ≥ R | 800 [V] | 1000 [V] | 1000 [V] |

C1

IMAGE FORMING APPARATUS WITH A CHARGING POWER SUPPLY THAT OUTPUTS AN AC BIAS AND A DC BIAS

The entire disclosure of Japanese patent Application No. 2018-186457, filed on Oct. 1, 2018, is incorporated herein by reference in its entirety.

BACKGROUND

Technological Field

The present invention relates to an image forming apparatus which charges photoreceptors and forms an image.

Description of the Related Art

An electrographic image forming apparatus uniformly charges circumferential surfaces of photoreceptors of cylindrical shapes, performs pattern exposure matching image data in a state where the photoreceptors are stably rotating, thereby partially removes charges on the circumferential surface and forms a latent image. Furthermore, a toner is adhered to the circumferential surface of the photoreceptor to visualize the latent image as a toner image, and this toner image is transferred to form an image on sheets (recording media).

Contact charging (contact scheme) is often used as a scheme for charging a photoreceptor. Contact charging is a scheme for disposing a charging member such as a roller or a brush in contact with the photoreceptor, applying a voltage to the charging member and causes discharging between the charging member and the photoreceptor The photoreceptor and the charging member do not need to be strictly in contact, and there is also contact charging for providing a fine gap of approximately 1 mm at maximum and placing the photoreceptor and the charging member close to each other.

Although contact charging includes DC charging for applying a direct current voltage to the charging member, and AC charging for applying an alternating current voltage on which the direct current voltage has been superimposed, AC charging having better uniformity of charging than DC charging is generally used.

According to contact charging, discharging occurs near the photoreceptor, and therefore the surface of the photoreceptor readily deteriorates compared to non-contact charging. A deteriorated surface layer is rubbed against the charging member and is peeled, and therefore a progress of grinding of the photoreceptor is fast. Furthermore, corona products are likely to adhere to the photoreceptor. The adhered corona products cause dotted image noise or lowers cleaning performance for the surface of the photoreceptor.

A phenomenon which occurs during contact charging becomes particularly remarkable when AC charging is adopted. This is because, according to AC charging, an amplitude of an application voltage is twice or more as a discharge start voltage, and therefore a discharge current amount is inevitably larger than that of DC charging.

As related art for preventing deterioration of a photoreceptor or occurrence of image noise due to contact charging, there are techniques disclosed in JP 4-37776 A, JP 11-272023 A, JP 11-160965 A, JP 2003-217035 A and JP 2007-94354 A.

JP 4-37776 A and JP 11-272023 A disclose performing AC charging during execution of image formation, and performing DC charging during non-image formation. JP 11-160965 A discloses performing neither AC charging nor DC charging during non-image formation.

JP 2003-217035 A discloses turning off application of an alternating current voltage, then turning off application of a direct current voltage, and subsequently stopping rotating image carriers (photoreceptors) as a sequence after image formation of AC charging is finished.

JP 2007-94354 A discloses setting a regular charging period for performing AC charging, and a weak charging period for performing weaker charging than strength which is necessary for latent image formation, and turning off or lowering the alternating current voltage during the weak charging period.

Furthermore, there is related art for using AC charging and DC charging separately according to a state of an image forming apparatus when forming images. That is, JP 2018-45114 A discloses performing AC charging in a case of a state where the film thickness of a photoreceptor is large and appropriate discharging hardly occurs, and performing DC charging in a case where the film thickness decreases due to use of the photoreceptor and DC charging can cause appropriate discharging.

A period during which the photoreceptor needs to be charged is not limited to a time of image formation for forming a latent image corresponding to an image to be formed on a sheet and outputted. During a non-image forming operation of rotating and driving the photoreceptor without forming a latent image, too, the photoreceptor is charged in some cases.

The non-image forming operation is performed during a warming period disclosed in JP 4-37776 A, a pre-rotation period, a sheet interval and a post-rotation period, and, in addition, a time of forced toner replenishment, a time of various types of cleaning processing and a time of image stabilization. A color image forming apparatus which includes a plurality of photoreceptors in particular rotates the photoreceptors associated with other colors in conjunction with the photoreceptor associated with the color during image adjustment of one of colors.

When, for example, charging is stopped during forced toner replenishment, a potential balance between the photoreceptor and an operating developer becomes inappropriate, and a toner is concerned to adhere to the photoreceptor or scatter around. Therefore, charging is performed during forced toner replenishment.

Conventionally, quality of charging does not result in whether an image is good or bad during the non-image forming operation. Therefore, quality of DC charging has not been taken into account.

However, it has been found that, when DC charging for charging photoreceptors at the same potential as that during image formation is performed during the non-image forming operation, a potential setting during the image formation causes over-discharge, and charging potentials of the photoreceptors become locally and excessively high.

In, for example, an image forming apparatus which performs two-component development, carriers adhere to a portion at which charging potential has become excessively high due to over-discharge. Hence, the photoreceptor, a transferred body of a toner image and other members are damaged, and image failure occurs due to the damages caused. That is, a problem that, when over-discharge occurs, damaged members need to be exchanged have become apparent.

In recent years, contact charging starts being used for high speed machines, too, and low-resistance charging member is demanded as a contact-type charging member to support a high frequency accompanying a high speed of AC charging. When the low-resistance charging member which is suitable to high speed AC charging is used to perform DC charging, over-discharge is likely to occur compared to a case where a relatively high-resistance charging member is used to perform DC charging.

SUMMARY

The present invention has been made in view of the above problem, and an object of the present invention is to improve quality of DC charging performed during a non-image forming operation compared to a conventional technique.

To achieve the abovementioned object, according to an aspect of the present invention, an image forming apparatus reflecting one aspect of the present invention comprises: a photoreceptor; a charging member that charges the photoreceptor; a charging power supply that outputs an AC bias as a charging bias to be applied to the charging member during image formation, and outputs a DC bias as the charging bias during a non-image forming operation, the AC bias being obtained by superimposing an alternating current voltage and a direct current voltage, the image formation forming a latent image corresponding to a print target image, the DC bias being a direct current voltage, and the non-image forming operation rotating and driving the photoreceptor while not forming the latent image; a processor that performs predetermined processing on the photoreceptor charged by the charging member; and a controller that controls the charging power supply and the processor such that a value of a potential difference of the photoreceptor before and after being charged by the DC bias is a value equal to or less than a setting value during the non-image forming operation.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

Figure 1:
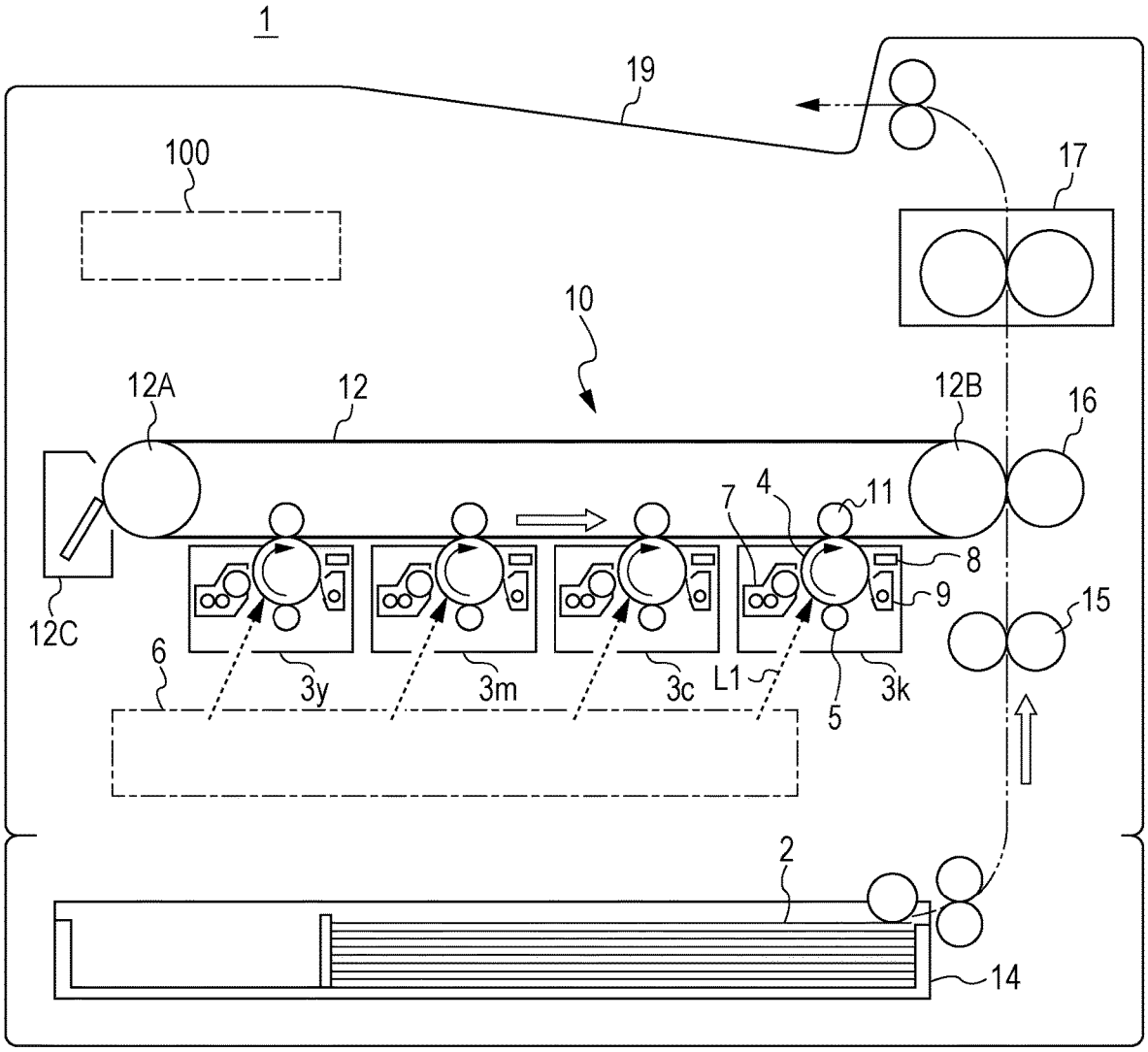
FIG. 1 is a view illustrating an outline of a configuration of an image forming apparatus according to an embodiment of the present invention.
Figure 2A:
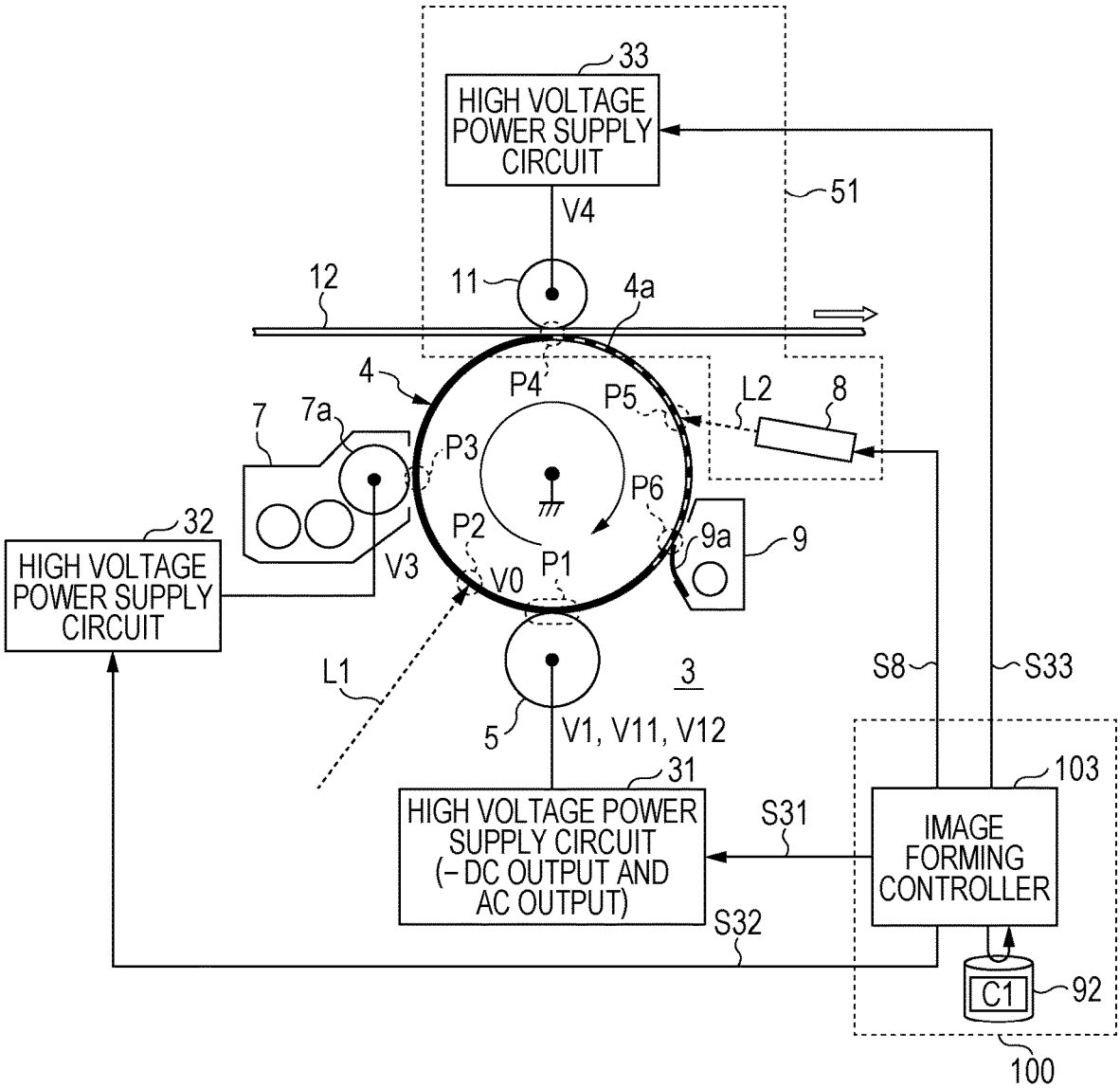
FIGS. 2A and 2B are views illustrating a configuration of main parts related to charging of a photoreceptor.
Figure 2B:
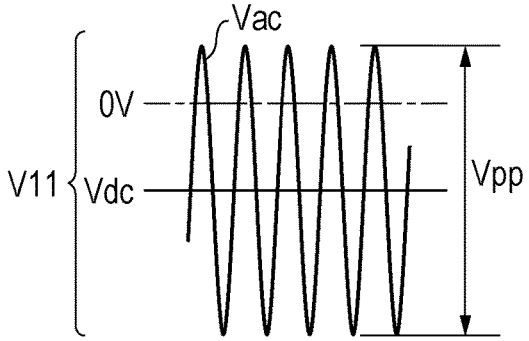

FIG. 1 is a view illustrating an outline of a configuration of an image forming apparatus 1 according to an embodiment of the present invention. FIGS. 2A and 2B are views illustrating a configuration of main parts related to charging of a photoreceptor 4.

The image forming apparatus 1 illustrated in FIG. 1 is an electrographic color printer which includes a tandem-type printer engine 10. The image forming apparatus 1 forms a color or monochrome image according to a job inputted from an external host device via a network. The image forming apparatus 1 includes a control circuit 100 which controls an operation of the image forming apparatus 1. The control circuit 100 includes a processor which executes a control program, a Read Only Memory (ROM), a Random Access Memory (RAM) and a non-volatile memory.

The printer engine 10 includes four imaging units 3*y*, 3*m*, 3*c* and 3*k*, a print head 6 and an intermediate transfer belt 12.

The imaging units 3*y* to 3*k* each include the photoreceptor 4 of a cylindrical shape, a charging roller 5, a developer 7, an eraser 8 and a cleaner 9. The photoreceptor 4 is an image carrier for forming a latent image. Basic configurations of the imaging units 3*y* to 3*k* are the same, and therefore will be referred to as an "imaging unit 3" without distinguishing these imaging units below.

The print head 6 emits laser beams L1 for performing pattern exposure on each of the imaging units 3*y* to 3*k*. The print head 6 performs main scan for deflecting the laser beams L1 in a rotary axis direction of the photoreceptors 4. In parallel to this main scan, sub scan for rotating the photoreceptors 4 at a constant speed is performed.

The intermediate transfer belt 12 is a transferred body of primary transfer of the toner image. The intermediate transfer belt 12 is wound and rotated between a pair of rollers 12A and 12B. As a material of the intermediate transfer belt 12, a semiconductive material obtained by dispersing carbon by using polycarbonate, polytetrafluoroethylene (PTFE) or polyimide as a main raw material is used. Inside the intermediate transfer belt 12, a primary transfer roller 11 is disposed per imaging units 3*y*, 3*m*, 3*c* and 3*k*.

In a color printing mode, the imaging units 3*y* to 3*k* form toner images of four colors including Y (yellow), M (magenta), C (cyanogen) and K (black) in parallel. The toner images of the four colors are primarily transferred sequentially to the rotating intermediate transfer belt 12. The Y toner image is first transferred, and the M toner image, the C toner image and the K toner image are sequentially transferred so as to overlap the Y toner image.

When facing a secondary transfer roller 16, the primarily transferred toner images are secondarily transferred to a sheet (recording medium) 2 taken out from a paper cassette 14 on a lower side and conveyed via a timing roller 15. The sheet 2 to which the toner images have been transferred passes inside a fixing device 17, and is outputted to a paper delivery tray 19 on an upper side. When passing the fixing device 17, the toner images are heated and pressurized, and fixed to the sheet 2.

In each imaging unit 3, the photoreceptor 4 is cleaned by the cleaner 9 every time primary transfer is finished, and prepares for a next image forming cycle. The intermediate transfer belt 12 is cleaned by, for example, a blade-type belt cleaner 12C. The belt cleaner 12C is disposed at a position facing the roller 12A close to the imaging unit 3*y*. A blade of the belt cleaner 12C comes into pressure contact with the intermediate transfer belt 12 at all times.

As illustrated in FIG. 2A, the image forming apparatus 1 includes an image forming controller 103 which performs control related to image formation of the imaging unit 3. A function of the image forming controller 103 is realized by a hardware configuration of the control circuit 100 and when a control program is executed by a CPU.

In FIG. 2A, the photoreceptor 4 is driven to rotate in one direction integrally with a drum which is a support body. While the photoreceptor 4 is rotating, the circumferential surface of the photoreceptor 4 repeatedly passes a charging position P1, an exposure position P2, a development position P3, a transfer position P4, a charge removal position P5 and a cleaning position P6 in order.

The photoreceptor 4 is a laminated organic photoreceptor formed by laminating an undercoat layer, a charge generation layer including organic molecules and a charge transportation layer on a conductive substrate. The thickness of the charge transportation layer related to an operational life of the photoreceptor 4 is, for example, approximately 30 to 40 μm.

The charging roller 5 comes into contact with the photoreceptor 4 at the charging position P1, and is driven by the photoreceptor 4 to rotate. The charging position P1 includes a nip portion of the charging roller 5 and the photoreceptor 4, and a proximity of the nip portion. The charging roller 5 is formed by a core bar made of a metal, and a semiconductive rubber layer of a roll shape supported by the core metal. A value within a range of 10^4 to 10^8 Ω·cm is selected for a volume resistivity of the semiconductive rubber layer. The semiconductive rubber layer may be a single layer structure or a multilayer structure.

This charging roller 5 is applied a charging bias V1 by a high voltage power supply circuit 31 connected with the core metal. According to a control signal S31 from the image forming controller 103, the high voltage power supply circuit 31 outputs an AC bias V11 as the charging bias V1 during image formation, and outputs a DC bias V12 as the charging bias V1 during a non-image forming operation. As illustrated in FIG. 2B, the AC bias V11 is a high frequency voltage obtained by superimposing an alternating current voltage Vac and a direct current voltage Vdc. The DC bias V12 is a direct current voltage. That is, AC charging is performed during image formation, and DC charging is performed during the non-image forming operation.

By performing AC charging only during image formation, wear of the photoreceptor 4 is reduced, and the operational life of the photoreceptor 4 increases compared to a case where AC charging is performed during the non-image forming operation, too.

According to AC charging, by making the amplitude (peak-to-peak voltage) Vpp of the alternating current voltage Vac sufficiently high, it is possible to cause discharging irrespectively of aging of the film thickness of the photoreceptor 4, and charge the photoreceptor 4 at a potential corresponding to the direct current voltage Vdc. Hence, according to AC charging, the value of the direct current voltage Vdc is set according to a target (desired) charging potential V0 without taking the film thickness of the photoreceptor 4 into account. The charging potential V0 is a surface potential of the photoreceptor 4 immediately after charging.

When, for example, the value of the target charging potential V0 is −600 volt, the direct current voltage Vdc is −600 volt. The amplitude Vpp of the alternating current voltage Vac is approximately 2000 volt, and the frequency is approximately 2 kHz.

On the other hand, according to DC charging, a relationship of equation (1) holds for a DC bias V12.

$$V12=V0+Vth \quad (1)$$

where Vth is a discharge start voltage.

The discharge start voltage Vth is influenced by an environment condition (mainly a humidity) and a durability condition (mainly the film thickness of the photoreceptor 4). Hence, the DC bias V12 is set to a value corresponding to the target charging potential V0 by correcting the discharge start voltage Vth according to the environment condition and the durability condition. When, for example, the value of the target charging potential V0 is −600 volt and the discharge start voltage Vth is −600 volt, the DC bias V12 is −1200 volt.

The direct current voltage Vdc during image formation and the DC bias V12 during the non-image forming operation are both minus (negative polarity) voltages. When the direct current voltage Vdc or the DC bias V12 is applied to the charging roller 5, a region (which is referred to as a "pre-charging region 4*a*") passes the transfer position P4 of the circumferential surface of the rotating photoreceptor 4 toward the charging position P1 is a potential on a relatively plus side with respect to the charging roller 5.

In a state illustrated in FIG. 2A, as distinguished from other regions by drawing a white broken line in FIG. 2A, a region from the transfer position P4 of the photoreceptor 4 to a portion which passes the cleaning position P6 is the pre-charging region 4*a*. When the photoreceptor 4 further rotates in this state, the overall region from the transfer position P4 to the charging position P1 becomes the pre-charging region 4*a*.

When the pre-charging region 4*a* of the photoreceptor 4 arrives at the charging position P1, discharging starts between the pre-charging region 4*a* and the charging roller 5. When the pre-charging region 4*a* passes the charging position P1, discharging stops. According to discharging, minus charges are given to the photoreceptor 4, and the surface potential of the photoreceptor 4 becomes the charging potential V0. As described above, this charging potential V0 depends on the direct current voltage Vdc (during image formation) or the DC bias V12 (during the non-image forming operation).

At the exposure position P2, the laser beam L1 from the print head 6 enters the photoreceptor 4. By performing pattern exposure when the uniformly charged region of the photoreceptor 4 passes the exposure position P2, it is possible to form a latent image. According to the pattern exposure, the laser beam L1 is intermittent or the light intensity of the laser beam L1 is modulated. During image formation, the pattern exposure is performed based on print data corresponding to an image which is designated by a job and needs to be outputted, and the latent image corresponding to the image which needs to be outputted is formed.

In addition, the pattern exposure is performed not only during image formation, but also during the non-image forming operation. When, for example, a test toner pattern is formed for image stabilization, too, pattern exposure is performed. In this regard, a latent image formed in this case corresponds to a toner pattern which is discarded without being transferred to the sheet 2, and does not correspond to a print target image which needs to be outputted.

The developer 7 adheres a toner to the circumferential surface of the photoreceptor 4 which passes the development position P3, and visualizes a latent image as a toner image. In the present embodiment, the developer 7 is a two-component developer, and mixes and stirs the toner and carriers and charges the toner with the minus polarity. Furthermore, the charged toner is supplied by a sleeve 7*a* to the development position P3. The sleeve 7*a* is applied a development bias V3 by the high voltage power supply circuit 32.

The high voltage power supply circuit 32 outputs an alternating current voltage on which a minus direct current voltage has been superimposed as the development bias V3 according to a control signal S32 from the image forming controller 103. For example, the direct current voltage is set to −400 volt, the amplitude of the alternating current voltage is set to 1500 volt, and the frequency is set to 3 kHz.

At the transfer position P4, the intermediate transfer belt 12 is pressed by the primary transfer roller 11 and comes into contact with the photoreceptor 4. In this case, the primary transfer roller 11 is applied a transfer bias V4 by a high voltage power supply circuit 33. A transfer electric field formed by the transfer bias V4 primarily transfers the toner image from the photoreceptor 4 to the intermediate transfer belt 12.

The high voltage power supply circuit 33 is a direct current power supply circuit of a monopolar output type. In this regard, the high voltage power supply circuit 33 may be a bipolar output type. The output of the high voltage power supply circuit 33 is controlled according to a control signal S33 from the image forming controller 103.

The eraser 8 irradiates the photoreceptor 4 which passes the charge removal position P5 with a light beam L2 which decreases residual charges. A light source of the eraser 8 is a light emitting diode array which emits, for example, visible light of 685 nm in wavelength, and can irradiate (full exposure) the entire dimension in the rotary axis direction of the photoreceptor 4. The eraser 8 includes a feeder circuit which causes the light source to emit light, and radiates or stops radiating the light beam L2 according to a control signal S8 from the image forming controller 103. An illumination intensity is variable. When the light beam L2 is radiated, the surface potential of the photoreceptor 4 becomes 0 volt or a value of approximately −10 to 0 volt close to 0 volt.

According to the present embodiment, the eraser 8, and the primary transfer roller 11 and the high voltage power supply circuit 33 make up a processor 51. The processor 51 performs primary transfer and charge removal related to the potential of the pre-charging region 4*a* among processing performed on the photoreceptor 4 charged by the charging roller 5.

The cleaner 9 removes an adhered material such as a remaining toner from the circumferential surface of the photoreceptor 4 which passes the cleaning position P6. A scheme of the cleaner 9 is a blade cleaning scheme of scraping the adhered material by, for example, an elastic blade 9*a* which is in pressure contact with the photoreceptor 4 at all times. This scheme may be other schemes which use a brush or a roller.

Furthermore, the image forming controller 103 controls the high voltage power supply circuit 31 and the processor 51 so as not to cause over-discharge during DC charging performed during the non-image forming operation. More specifically, the image forming controller 103 sets on and off of the DC bias V12, the transfer bias V4 and the eraser 8 such that a value of a potential difference of the photoreceptor 4 before and after charging by the DC bias V12 during the non-image forming operation is a value equal to or less than a threshold C1. This threshold C1 is a value set based on a fact described below, and is a value different from the value of the potential difference of the photoreceptor 4 before and after AC charging during image formation.

Figure 3:
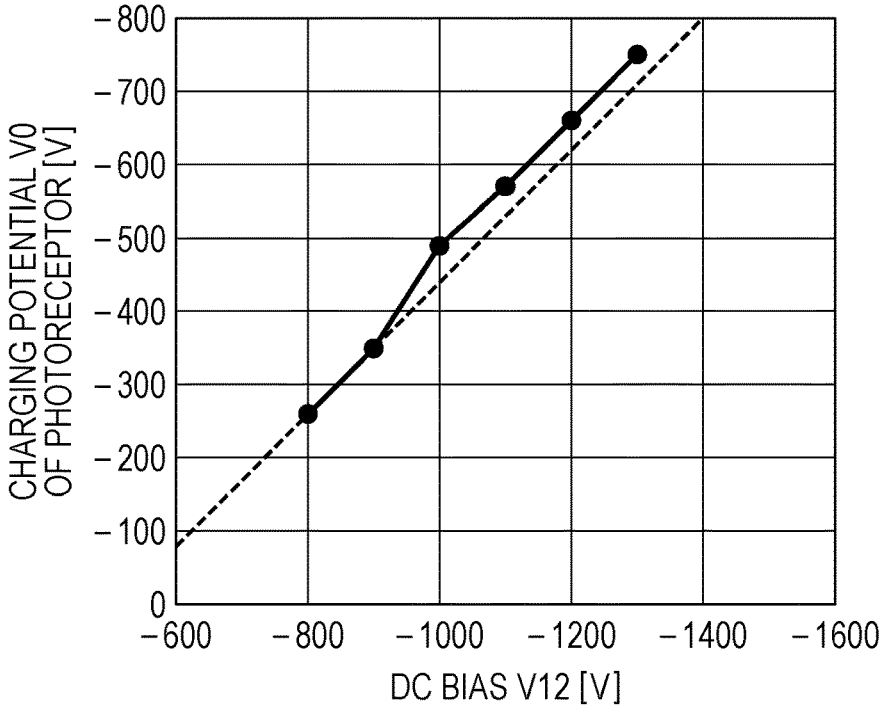
FIG. 3 is a graph illustrating an example of DC charging characteristics of the photoreceptor.

FIG. 3 is a graph illustrating an example of DC charging characteristics of the photoreceptor 4. A horizontal axis indicates a value of the DC bias V12, and a vertical axis indicates a value of the charging potential V0 of the photoreceptor 4. A unit of the value is volt (V) on the both axes.

In a normal case, i.e., when over-discharge does not occur, the charging potential V0 is proportional to the DC bias V12 as indicated by a broken line in FIG. 3. However, when over-discharge occurs, the charging potential V0 shifts in such a direction that the charging potential V0 becomes high compared to the normal case.

A measurement value of the charging potential V0 is an average value of the potentials in a target region of a size which depends on measurement environment. Hence, when development is performed after DC charging and a test image is formed to check uniformity of charging in a case where over-discharge occurs, the test image formed in a case where the over-discharge occurs has mesh-patterned noise. That is, an actual charging state in a case where the over-discharge occurs is a state where not only the charging potential V0 is shifted compared to the normal case but also the potential has unevenness and is non-uniform.

During the non-image forming operation, to, the sleeve 7*a* of the developer 7 is biased so as to be able to obtain an appropriate potential difference (e.g., 150 to 200 volt) for the charging potential V0 to prevent adhesion of an unnecessary toner. Hence, carriers during two-component development adhere to an excessively minus-charged portion due to over-discharge of the photoreceptor 4.

The carriers having been separated from the developer 7 damage the photoreceptor 4, the intermediate transfer belt 12 and the fixing device 17. Image failure occurs due to the damages caused, and therefore damaged members need to be exchanged. That is, occurrence of over-discharge indirectly lowers image quality, and raises running cost of part exchange.

Hence, not only during image formation but also during the non-image forming operation, it is necessary to make quality (uniformity) of charging good.

A condition that over-discharge which undermines quality of DC charging has been investigated, and a following result has been obtained.

Figure 4:
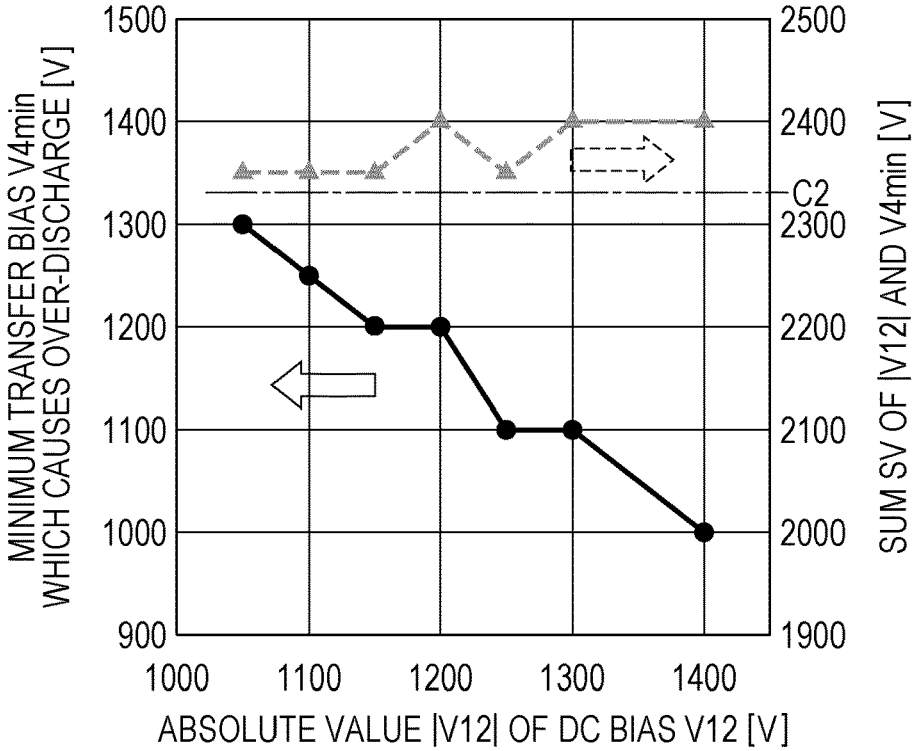
FIG. 4 is a graph illustrating an over-discharge occurrence condition in a case where an eraser does not remove charges.
Figure 5:
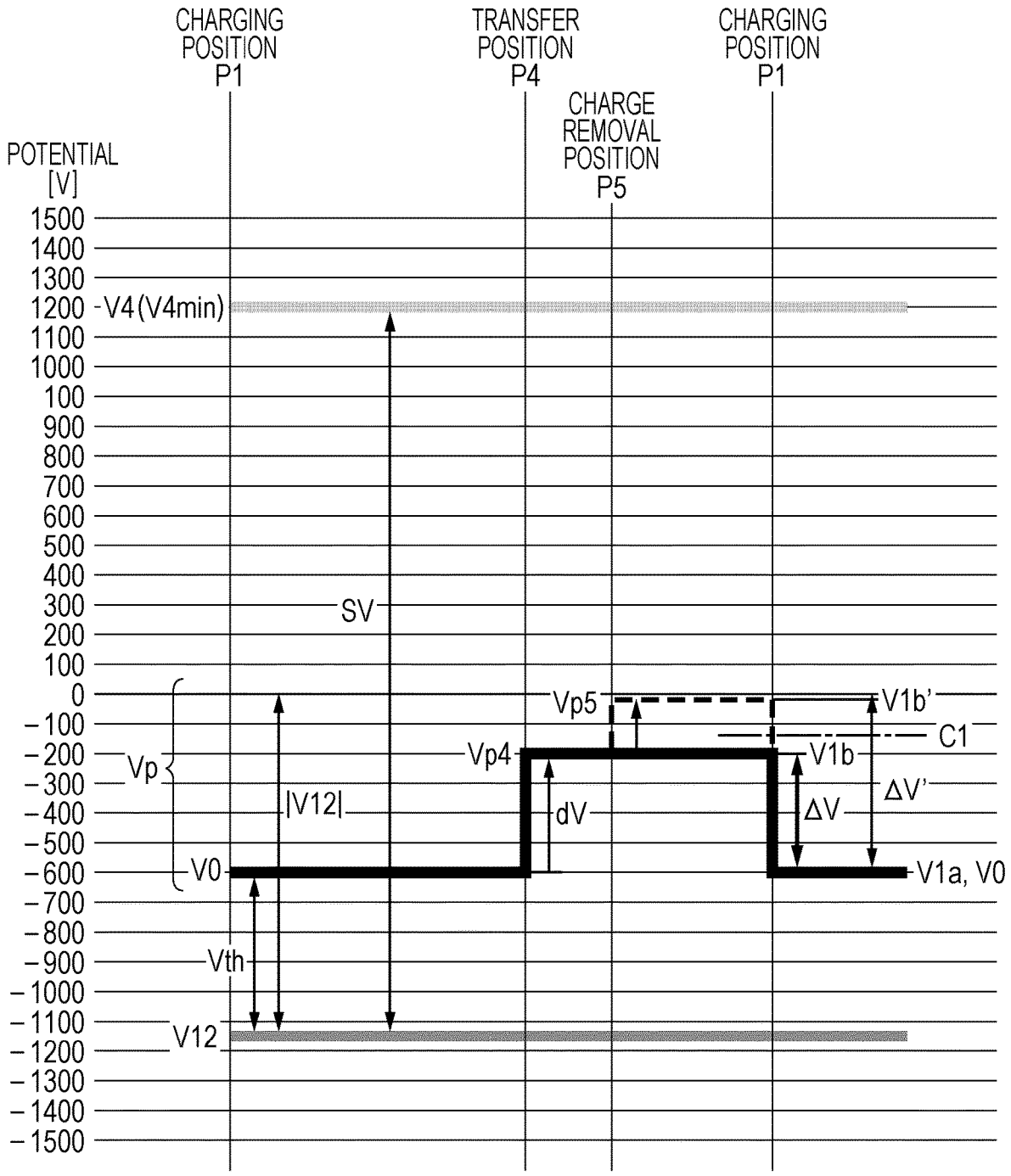
FIG. 5 is a view illustrating an example of a transition of a surface potential of the photoreceptor.

FIG. 4 is a graph illustrating an over-discharge occurrence condition in a case where the eraser 8 does not remove charges. FIG. 5 is a view illustrating an example of a transition of a surface potential Vp of the photoreceptor 4.

In FIG. 4, a horizontal axis indicates an absolute value |V12| of the DC bias V12. A left vertical axis indicates a value of a minimum transfer bias V4 min at which over-discharge occurs.

A right vertical axis indicates a value of a sum SV of the absolute value |V12| of the DC bias V12 and the minimum transfer bias V4 min. Furthermore, a solid line indicates a relationship between the absolute value |V12| of the DC bias V12 and the minimum transfer bias V4 min, and a broken line indicates a relationship between the absolute value |V12| of the DC bias V12 and the sum SV.

In addition, irrespectively of polarities of various biases (application voltages) such as the charging bias V1 in the first place, this description expresses a great difference (i.e., absolute value) between the value of this bias and 0 as "high" and expresses making the difference greater as "increase". Furthermore, this description expresses the little difference as "low", and expresses making the difference small as "lower". Hence, when the polarity is minus, for example, −1000 volt is higher than −500 volt. When the polarity is plus, 1000 volt is higher than 500 volt.

In FIG. 4, when the absolute value |V12| of the DC bias V12 is larger, even if the value of the transfer bias V4 is relatively smaller, over-discharge occurs. That is, when the DC bias V12 is higher, even if the transfer bias V4 is much lower, over-discharge occurs.

Furthermore, irrespectively of whether the absolute value |V12| of the DC bias V12 is large or small, the sum SV at which over-discharge occurs is substantially a constant value (2350 to 2400 volt). That is, it is found that, when the sum SV is the constant value or more, over-discharge occurs.

As illustrated in FIG. 5, when passing the transfer position P4 in a state where the transfer bias V4 is applied, the surface potential Vp of the photoreceptor 4 lowers from the charging potential V0 and becomes post-transfer potential Vp4. The post-transfer potential Vp4 depends on the charging potential V0 and the transfer bias V4, and becomes not only a minus potential in an example in FIG. 5 but also becomes a plus potential. When the charging potential V0 before lowering is constant, a decrease amount dV which is a difference between the charging potential V0 and the post-transfer potential Vp4 is higher as the transfer bias V4 is higher. By contrast with this, when the transfer bias V4 is constant, as the charging potential V0 before lowering is lower, the decrease amount dV is smaller.

However, when the value of the charging potential V0 is switched to calculate the minimum transfer bias V4 min per plurality of values, the decrease amount dV due to application of the minimum transfer bias V4 min is substantially constant irrespectively of the value of the charging potential V0. More specifically, under a plurality of bias conditions plotted in FIG. 4, i.e., in a combination of the absolute value |V12| of the DC bias V12 (corresponding to the charging potential V0 before lowering) and the minimum transfer bias V4 min, each decrease amount dV was approximately 400 volt.

When the eraser 8 does not remove charges, until the pre-charging region 4*a* arrives at the charging position P1, the post-transfer potential Vp4 hardly changes and is kept, and becomes a pre-charging potential V1*b* (V1*b*=Vp4). The pre-charging potential V1*b* is the surface potential Vp immediately before discharging starts after the pre-charging region 4*a* arrives at the charging position P1.

Hence, occurrence of over-discharging in a case where the sum SV is the constant value or more means that, irrespectively of the post-charging potential V1*a* (i.e., charging potential V0) of DC charging, over-discharge occurs when a potential difference ΔV before and after charging exceeds the predetermined threshold C1. The potential difference ΔV before and after charging is a difference between the pre-charging potential V1*b* and the post-charging potential Via.

That is, by controlling the potential difference ΔV before and after charging to the predetermined threshold C1 or less, it is possible to prevent over-discharge during DC charging. Furthermore, the charging potential V0 is allowed to be optionally selected to make the potential difference ΔV the threshold C1 or less.

Hence, to make a potential difference dV4 before and after charging the threshold C1 or less, for example, the transfer bias V4 is made the same value as that during image formation, and the DC bias V12 is lowered (the absolute value is made smaller). Alternatively, the DC bias V12 and the transfer bias V4 are set such that the sum SV of the absolute value |V12| of the DC bias V12 and the transfer bias V4 is a predetermined threshold C2 or less illustrated in FIG. 4.

By the way, the image forming apparatus 1 performs full exposure on the photoreceptor 4 before charging by operating the eraser 8 provided on a downstream side of the transfer position P4 during image formation. Consequently, non-uniformity of the surface potential Vp due to pattern exposure is resolved, so that uniformity of subsequent charging increases.

During the non-image forming operation, too, it is possible to operate the eraser 8. However, when the eraser 8 is operated during the non-image forming operation, the surface potential Vp of the photoreceptor 4 becomes lower than the post-transfer potential Vp4, and becomes a post-charge removal potential Vp5 which is substantially 0 volt as indicated by a broken line in FIG. 5. Furthermore, this post-charge removal potential Vp5 becomes a pre-charging potential V1*b*', and a potential difference ΔV' before and after charging becomes greater than the potential difference ΔV in a case where the eraser 8 is not operated. Hence, even when the transfer bias V4 is low compared to the example in FIG. 4, over-discharge is concerned to occur. Hence, during the non-image forming operation, the eraser 8 preferably stops removing charges.

Furthermore, over-discharge is more likely to occur when a resistance value of the charging roller 5 is lower, and is more likely to occur when the film thickness of the photoreceptor 4 is thicker. Hence, the threshold C1 is preferably changed according to states of the charging roller 5 and the photoreceptor 4.

Next, an example of control related to DC charging will be described.

Figure 6:
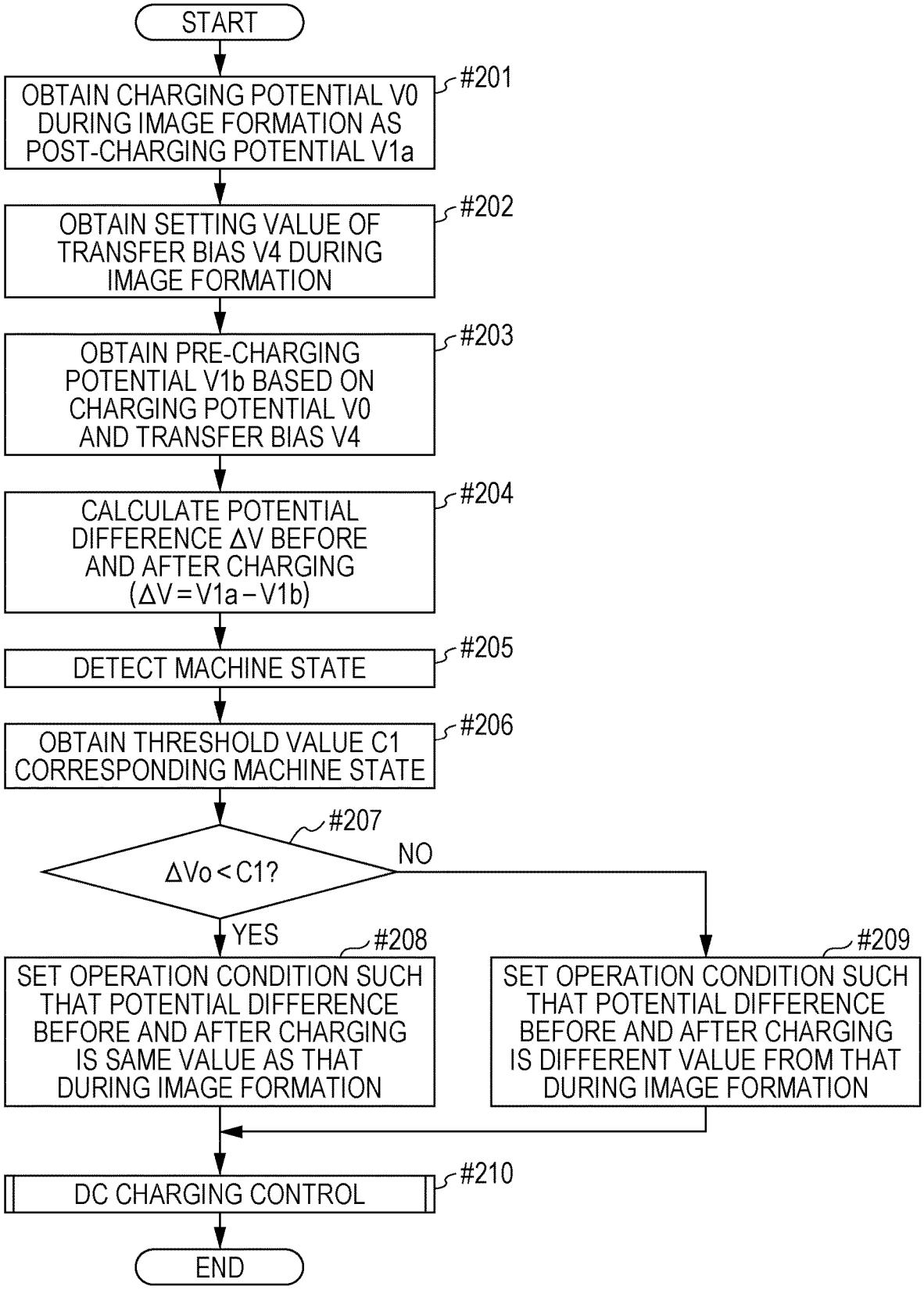
FIG. 6 is a view illustrating an example of a flow of processing related to DC charging during a non-image forming operation of an image forming apparatus.
Figure 7:
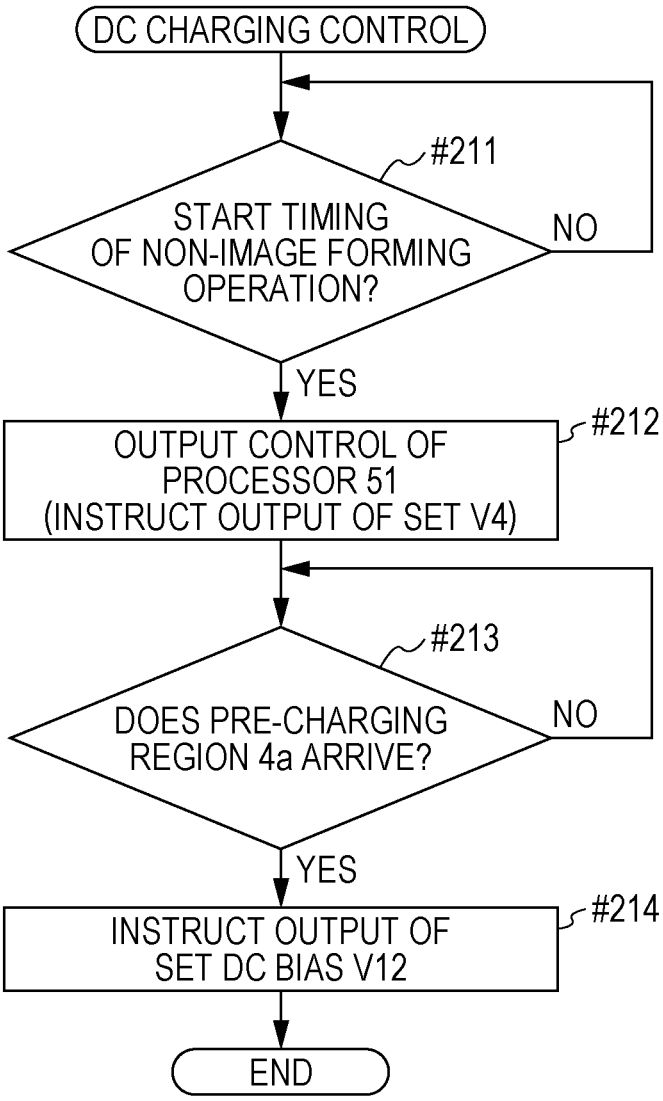
FIG. 7 is a view illustrating a flow of processing of DC charging control.
Figures 8, 9:
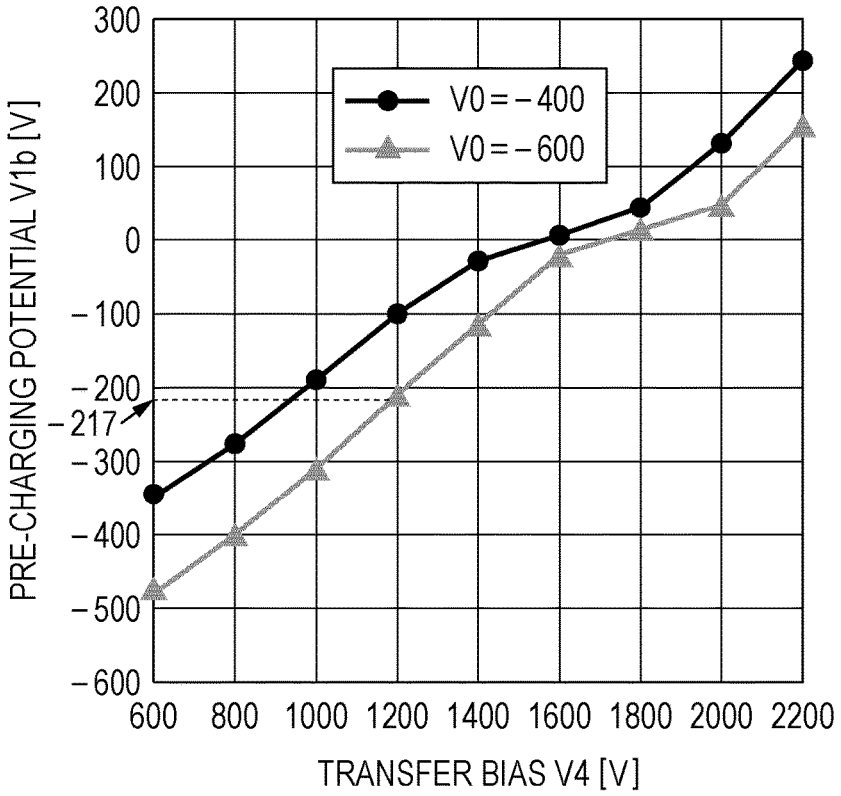
FIG. 8 is a graph illustrating a relationship between a transfer bias and a pre-charging potential in a case where charges are not removed.
FIG. 9 is a view illustrating an example of threshold information.
Figure 10:
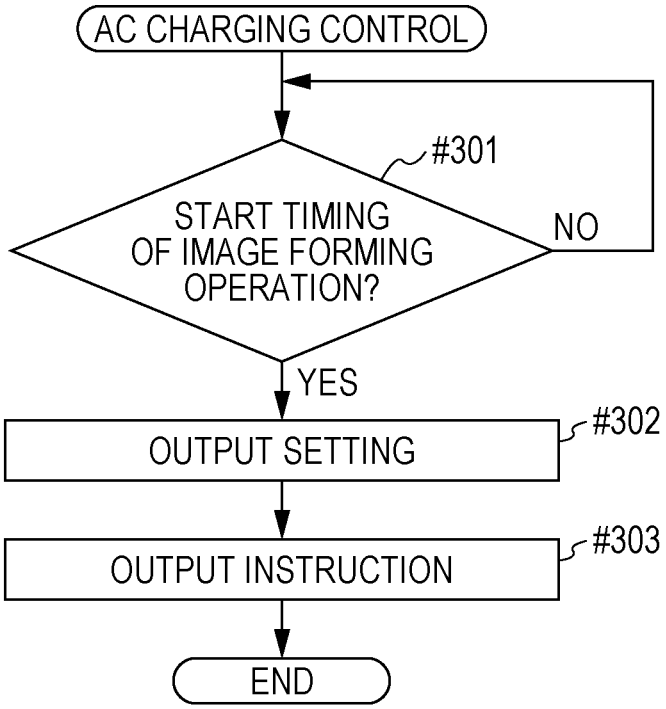
FIG. 10 is a view illustrating a flow of processing of AC charging control.

FIG. 6 is a view illustrating an example of a flow of processing related to DC charging during the non-image forming operation of the image forming apparatus 1. FIG. 7 is a view illustrating a flow of processing of DC charging control. FIG. 8 is a graph illustrating a relationship between the transfer bias V4 and the pre-charging potential V1*b* in a case where charges are not removed. FIG. 9 is a view illustrating an example of threshold information 92. FIG. 10 is a view illustrating a flow of processing of AC charging control.

In FIG. 6, the image forming controller 103 obtains the charging potential V0 during image formation as the post-charging potential V1*a* at a predetermined timing before the non-image forming operation starts (#201). This timing can come immediately before, for example, image formation switches to the non-image forming operation. This timing is not limited to a timing during image formation, and may be a timing before the photoreceptor 4 starts being driven and rotating, i.e., a timing which is not during image formation or during the non-image forming operation.

As described above, the direct current voltage Vdc matching the target charging potential V0 is applied according to AC charging during image formation, and therefore a setting value of the direct current voltage Vdc of the AC bias V11 is obtained as the post-charging potential Via. In this regard, when the direct current voltage Vdc is set to correct a shift between the charging potential V0 and the direct current voltage Vdc due to aging of the photoreceptor 4, the direct current voltage Vdc before correction (i.e., target charging potential V0) is obtained.

In addition, generally, the setting value of the charging potential V0 among setting values of an image forming operation is determined as a constant value matching a specification of the image forming apparatus 1. The setting value of the charging potential V0 is, for example, −600 volt or −400 volt. Furthermore, the image forming operation is optimized under several conditions (an image shade, the thickness of the color/monochrome sheet 2 and the environment condition) by adjusting other setting values around the photoreceptor based on the charging potential V0.

After obtaining the post-charging potential Via, the image forming controller 103 obtains the setting value of the transfer bias V4 (#202). When the setting value is obtained during image formation, the setting value of the transfer bias V4 to be applied to a current image forming operation is obtained. When the setting value is obtained other than during image formation, the setting value of the transfer bias V4 stored to be applied in an image formation mode (e.g., a mode of forming a monochrome image on plain paper at a standard speed) defined as a standard mode is read.

Next, the image forming controller 103 obtains the pre-charging potential V1*b* specified based on the charging potential V0 and the transfer bias V4 (#203).

To obtain this pre-charging potential V1*b*, a relationship illustrated in FIG. 8 is calculated in advance, and is stored in a format of a lookup table, an interpolation arithmetic formula or data obtained by combining the lookup table and the interpolation arithmetic formula in a non-volatile memory. The image forming controller 103 reads from the lookup table the pre-charging potential V1*b* corresponding to the obtained setting values of the charging potential V0 and the transfer bias V4, and calculates the pre-charging potential V1*b* by using the interpolation arithmetic formula.

FIG. 8 illustrates the pre-charging potential V1*b* when the charging potential V0 is −600 volt and −400 volt. According to a relationship illustrated in FIG. 8, a value of the pre-charging potential V1*b* obtained when, for example, the charging potential V0 is −600 volt and the transfer bias V4 is −1200 is approximately −217 volt.

In addition, when the eraser 8 is operated to remove charges, the post-charge removal potential Vp5 which is the surface potential Vp after removal of the charges is calculated in advance, and is stored as the pre-charging potential V1*b* in a non-volatile memory. When the post-transfer potential Vp4 is minus and is higher than the post-charge removal potential Vp5, the post-charge removal potential Vp5 is the pre-charging potential V1*b*. When the post-charge removal potential Vp5 significantly changes due to the durability condition or the environment condition, it is desirable to correct the pre-charging potential V1*b* read from the non-volatile memory according to these conditions.

When the pre-charging potential V1*b* is obtained in this way, the image forming controller 103 performs an arithmetic operation based on equation (2) and calculates the potential difference ΔV before and after charging (#204).

$$\Delta V = |V1a - V1b| \tag{2}$$

Subsequently, by referring to film thickness information of the photoreceptor 4 and environment measurement information of a sensor disposed at an appropriate portion inside the image forming apparatus 1, the image forming controller 103 detects a machine state (charging related state) related to charging (#205). More specifically, the image forming controller 103 detects a current film thickness D of the photoreceptor 4, and a humidity R in the surroundings of the photoreceptor 4.

The film thickness information used to detect the film thickness D may indicate the film thickness D measured by a known method for detecting a charging current, or may be durability information of the photoreceptor 4 such as the number of stacked printed pages or the cumulative number of times of rotation.

When detecting the machine state, the image forming controller 103 obtains the threshold C1 matching the machine state from the threshold information 92 illustrated in FIG. 9 (#206). The threshold information 92 is a lookup table indicating the thresholds C1 associated with a combination of a plurality of humidity levels obtained by values of the humidity R and film thickness levels obtained by partitioning values of the film thickness of the photoreceptor 4.

Each threshold C1 in the threshold information 92 is determined based on a result of an experiment for finding a minimum potential difference before and after charging at which DC charging causes over-discharge in each of a plurality of machine states. That is, a value which is smaller by a predetermined margin value than the found minimum potential difference is the threshold C1 in each machine state. In an example in FIG. 9, the threshold C1 in a case where, for example, the film thickness of the photoreceptor 4 is 28 μm or more and the humidity R exceeds 80% is 300 volt.

Next, the image forming controller 103 checks whether or not the previously calculated potential difference ΔV before and after charging is smaller than the threshold C1 matching a machine state (#207).

When the potential difference ΔV before and after charging is smaller than the threshold C1 (Yes in #207), an operation condition of each portion related to the surface potential Vp of the photoreceptor 4 during the non-image forming operation is set such that a transition of the surface potential Vp accompanying rotation of the photoreceptor 4 is similar to that during image formation (#208). Details are as follows.

First, a value of the target charging potential V0 is set to the same value as that during image formation. That is, an output value of the DC bias V12 is set to the high voltage power supply circuit 31 such that the charging potential V0 is the same value as that during image formation. The DC bias V12 is calculated according to the above equation (1), and, in this case, a value obtained by correcting a default value according to the humidity R and the film thickness D as a value of the discharge start voltage Vth is used.

The charging potential V0 is set to the same value as that during image formation, and therefore the development bias V3 and the transfer bias V4 may have the same values as those during image formation. Hence, output values of the high voltage power supply circuits 32 and 33 are set to the same values as those during image formation. Furthermore, on and off of the eraser 8 and the intensity of the light beam L2 are set to the same values as those during image formation.

According to these settings, DC charging performed during the subsequent non-image forming operation makes a value of a difference (potential difference ΔVdc) of the surface potential Vp before and after this DC charging the same value as the potential difference ΔV during image formation, and smaller than the threshold C1.

On the other hand, when the calculated potential difference ΔV before and after charging is not smaller than the threshold C1 (NO in #207), the operation condition of each portion related to the surface potential Vp is set such that the potential difference ΔVdc of the surface potential Vp before and after DC charging becomes smaller than the threshold C1 (#209). In this case, the calculated potential difference ΔV before and after charging during image formation is larger than the threshold C1. Therefore, by making the potential difference ΔVdc before and after DC charging smaller than the threshold C1, the potential difference ΔVdc takes a value different from the potential difference ΔV0 during image formation.

To make the potential difference ΔVdc smaller than the threshold C1, for example, the target charging potential V0 is made lower by, for example, 50 to 100 volt compared to during image formation. In this case, the output value of the high voltage power supply circuit 31 is set such that the DC bias V12 is lowered by a degree of decrease of the charging potential V0 and is outputted. As the charging potential V0 is lowered, the direct current voltage of the development bias V3 is also lowered.

When the charging potential V0 is changed in this way, a development high voltage power supply circuit which has a larger output variable range than a conventional one is necessary as the high voltage power supply circuit 32 in some cases. When, for example, application of the DC bias V12 is stopped in an extreme case, the charging potential V0 becomes substantially 0 volt, and therefore +150 volt needs to be applied as the direct current voltage of the development bias V3. A power supply circuit which has a larger output variable range and enables a bipolar output tends to become large.

Furthermore, when a toner is supplied during the non-image forming operation, the charging potential V0 is necessary to some degree or more, and therefore it is not possible to lower the target charging potential V0. Furthermore, there is also a case where the charging potential V0 needs to be maintained at a constant value over a time of image formation and a time of the non-image forming operation.

Hence, in a situation that it is difficult to lower the charging potential V0, the transfer bias V4 is lowered compared to during image formation. Consequently, it is possible to make the potential difference ΔVdc before and after charging smaller than the threshold C1.

In addition, when the polarity of the post-transfer potential Vp4 is minus, if charges are removed at the charge removal position P5 as described above, the surface potential Vp becomes 0, and the potential difference ΔVdc before and after charging increases during subsequent charging. Hence, in this case, irrespectively of whether to lower the charging potential V0 or to lower the transfer bias V4, the eraser 8 preferably stops radiation of the light beam L2.

After setting operation condition during the non-image forming operation such that the potential difference ΔVdc before and after charging becomes smaller than the threshold C1, the image forming controller 103 executes processing of DC charging control (#210).

As illustrated in FIG. 7, according to processing of DC charging control, the image forming controller 103 waits for an arrival of the start timing of the non-image forming operation (#211). When, for example, the image forming operation is currently performed, a timing to finish image formation and transition to post-processing such as cleaning or a timing to interrupt printing for image stabilization during printing of a plurality of sheets is the start timing of the non-image forming operation. Furthermore, when the image forming operation is not currently performed, a timing to start warming up to turn on a power supply switch or recover from a sleep state is this start timing.

When the start timing of the non-image forming operation arrives (Yes in #211), the image forming controller 103 first performs output control of the processor 51 (#212).

More specifically, the high voltage power supply circuit 33 is instructed to output the transfer bias V4 set in step #208 or step #209. In addition, the eraser 8 is controlled to turn off, and radiation of the light beam L2 is stopped.

When the processor 51 performs the output control, the image forming controller 103 waits for an arrival of a timing at which the pre-charging region 4*a* having passed the transfer position P4 in a state where the transfer bias V4 is applied according to the instruction in step #208 arrives at the charging position P1 (#213). That is, the image forming controller 103 waits for a time required by the photoreceptor 4 to rotate from the transfer position P4 to the charging position P1 to pass.

When a timing at which the pre-charging region 4*a* arrives at the charging position P1 arrives (Yes in #213), the high voltage power supply circuit 31 is instructed to output the DC bias V12 set in step #208 or step #209 (#214). Thus, DC charging starts.

In addition, when the image forming operation is switched to the image non-image forming operation, the output of the alternating current voltage Vac of the AC bias V11 is stopped when the DC bias V12 is instructed to be outputted or at an appropriate timing before the instruction. At the appropriate timing after DC charging starts, a value of the direct current voltage of the development bias V3 is changed if necessary.

By providing processing in step #213 and waiting for a predetermined time to pass to start DC charging, it is possible to prevent occurrence of over-discharge in a transition period of switch when AC charging is switched to DC charging. When DC bias V12 starts being outputted at the same time at which the transfer bias V4 is switched, until the pre-charging region 4*a* arrives at the charging position P1, the pre-charging potential V1*b* becomes a previous potential of AC charging, and therefore over-discharge is concerned to occur.

By contrast with this, in a case where DC charging is switched to AC charging, as illustrated in FIG. 10, when the start timing of the image forming operation arrives (YES in #301), the image forming controller 103 sets the operation condition related to the surface potential Vp and instructs an output of a control target (#302 and #303).

According to AC charging, charging and removal of charges are repeated at a shorter cycle than that of application of the alternating current voltage Vac. Therefore, even when over-discharge occurs, excessive charges due to the over-discharge are removed. Consequently, it is possible to change the operation condition without providing a waiting time for preventing the occurrence of the over-discharge, and quicken start of image formation.

According to the above embodiment, when the DC bias V12 is applied to charge the photoreceptor 4 during the non-image forming operation which does not form a latent image corresponding to an image to be outputted, it is possible to prevent occurrence of over-discharge, and improve quality of the charging compared to the conventional technique.

When a two-component developer is used to visualize a latent image, it is possible to prevent carriers from adhering to the photoreceptor 4 and other members, and prevent damages on the photoreceptor 4 due to adhesion of the carriers.

According to the above-described embodiment, the relationship in FIG. 4 may be used for simplification of control to determine the DC bias V12 and the transfer bias V4. In this case, the target charging potential V0 during image formation is obtained to find the DC bias V12 according to equation (1). Furthermore, the DC bias V12 and the transfer bias V4 are determined such that the sum SV of the absolute value |V12| of the DC bias V12 and the minimum transfer bias V4 min becomes smaller than the threshold C2 determined based on an experiment result in advance. This threshold C2 is desirably selected according to a machine state by using the same lookup table as that of the threshold information 92 in FIG. 9.

When the high voltage power supply circuit 33 controls a constant current to apply the transfer bias V4, an average voltage during the constant current control may be used or a convention table for a voltage value calculated by an experiment in advance may be used to specify the transfer bias V4.

Furthermore, when the eraser 8 removes charges, a conversion value from the post-charge removal potential Vp5 into the transfer bias V4 found in advance may be used as the value of the transfer bias V4. In this regard, the charges are not desirably removed, and the transfer bias V4 is preferably lowered.

According to a configuration where a corona discharge-type or contact-type charger is used as the eraser 8, it is possible to perform recharging instead of removal of charges depending on a potential condition of the photoreceptor 4. In this case, the eraser 8 may actively control the pre-charging potential V1*b* instead of or in combination of lowering of the transfer bias V4 without stopping removing the charges.

There may be employed a configuration where at least one of another environment condition such as the humidity R or the temperature, a cumulative used amount or the film thickness D of the photoreceptor 4, the cumulative used amount or the resistance value of the charging roller 5 is detected as a machine state, and the threshold C1 is switched according to a detection result.

According to the above embodiment, the time of the non-image forming operation includes a time of pre-processing of the image forming operation, a time of post-processing of the image forming operation, an interval period of pattern exposure corresponding to a paper interval in a case where a plurality of sheets 2 is used, a time of execution of various types of adjustment for appropriately keeping the machine state, and a time of rotation of the photoreceptor 4 which interlocks for adjustment of other colors. The various types of adjustment include forced toner replenishment in a case where a toner density in the developer 7 becomes low, cleaning of the intermediate transfer belt 12, cleaning of the vicinity of the secondary transfer roller 16, discharging of an unnecessary toner from the developer 7, creation of a toner band for supplying a toner or an external additive to a cleaning member, image stabilization processing, and removal of corona products adhered to the photoreceptor 4.

When, for example, a state such as warming-up other than the image forming operation transitions to the non-image forming operation, AC charging may be performed only during a short time during which the photoreceptor 4 rotates one to several times before DC charging starts. Consequently, it is possible to make the pre-charging potential V1*b* of first DC charging the predetermined post-transfer potential Vp4, and make the potential difference ΔV before and after charging the threshold C1 or less.

When the setting of the image forming operation is updated for image adjustment performed on an occasion that a user makes an instruction or the environment condition significantly changes, the output value related to DC charging may be updated and stored as preparation for the non-image forming operation, and DC charging may be performed by using this output value during the subsequent non-image forming operation.

According to the above embodiment, when a remaining toner amount which influences removal of charges is relatively large, a positional relationship between the eraser 8 and the cleaner 9 may be changed to remove the charges after the cleaner 9 cleans the photoreceptor 4.

In addition, configurations of entirety or each portion of the image forming apparatus 1, processing contents, orders or timings and contents of the threshold information 92 can be optionally changed according to the gist of the present invention.

Although embodiments of the present invention have been described and illustrated in detail, the disclosed embodiments are made for purposes of illustration and example only and not limitation. The scope of the present invention should be interpreted by terms of the appended claims.

What is claimed is:

1. An image forming apparatus comprising:

a photoreceptor;

a charging member that charges the photoreceptor;

a charging power supply that outputs an AC bias as a charging bias to be applied to the charging member during image formation, and outputs a DC bias as the charging bias during a non-image forming operation, the AC bias being obtained by superimposing an alternating current voltage and a direct current voltage, the image formation forming a latent image corresponding to a print target image, the DC bias being a direct current voltage, and the non-image forming operation rotating and driving the photoreceptor while not forming the latent image;

a processor that performs predetermined processing on the photoreceptor charged by the charging member; and a controller that controls the charging power supply and the processor such that a value of a potential difference of the photoreceptor before and after being charged by the DC bias is a value equal to or less than a setting value during the non-image forming operation.

2. The image forming apparatus according to claim 1, wherein the processor includes a transfer member that transfers to a transferred body a toner image obtained by developing the latent image, and a transfer power supply that outputs a transfer bias to be applied to the transfer member, and the controller lowers the transfer bias during the non-image forming operation compared to during the image formation.

3. The image forming apparatus according to claim 2, wherein the processor includes an eraser that irradiates a region with charge removal light, the region passing a transfer position facing the transfer member in the photoreceptor, and the controller stops performing the irradiation with the light during the non-image forming operation.

4. The image forming apparatus according to claim 3, wherein the controller controls the charging power supply such that, when a region of the photoreceptor faces the charging member, the DC bias is applied, the region having passed a charge removal position is irradiated with the light.

5. The image forming apparatus according to claim 2, wherein the controller controls the charging power supply such that, when a region of the photoreceptor faces the charging member, the DC bias is applied, the region facing the transfer member in a state where the transfer bias is lower than that during the image formation is applied.

6. The image forming apparatus according to claim 1, wherein the controller immediately switches application of the DC bias to application of the AC bias to the charging member when a start timing of an image forming operation arrives.

7. The image forming apparatus according to claim 1, wherein the controller uses as the setting value a value corresponding to a charging related state related to the charging of the photoreceptor.

8. The image forming apparatus according to claim 7, wherein the charging related state is at least one of an environment condition, a cumulative used amount or a film thickness of the photoreceptor, and a cumulative used amount or a resistance value of the charging member.

* * * * *